US010485315B2

(12) United States Patent
Selvi

(10) Patent No.: US 10,485,315 B2
(45) Date of Patent: Nov. 26, 2019

(54) ARTICLE OF LUGGAGE

(71) Applicant: it Luggage Limited, Hertfordshire (GB)

(72) Inventor: Sedat Selvi, Hertfordshire (GB)

(73) Assignee: IT Luggage Limited, Hertfordshire (GB)

( * ) Notice: Subject to any disclaimer, the term of this patent is extended or adjusted under 35 U.S.C. 154(b) by 119 days.

(21) Appl. No.: 15/169,930

(22) Filed: Jun. 1, 2016

(65) Prior Publication Data

US 2016/0345701 A1 Dec. 1, 2016

(30) Foreign Application Priority Data

Jun. 1, 2015 (GB) ..... 1509465.9

(51) Int. Cl.

| | |
|---|---|
| ***A45C 13/26*** | (2006.01) |
| ***A45C 13/04*** | (2006.01) |
| ***A45C 5/02*** | (2006.01) |
| ***A45C 5/03*** | (2006.01) |
| ***A45C 9/00*** | (2006.01) |
| *A45C 13/36* | (2006.01) |

(52) U.S. Cl.

CPC ..... *A45C 13/04* (2013.01); *A45C 5/02* (2013.01); *A45C 5/03* (2013.01); *A45C 9/00* (2013.01); *A45C 13/262* (2013.01); *A45C 13/36* (2013.01); *A45C 2009/002* (2013.01); *A45C 2013/267* (2013.01)

(58) Field of Classification Search

CPC ..... A45C 13/262; A45C 13/26; A45C 5/14; A45C 2013/267; A45C 3/02

USPC ..... 190/115, 100, 18 A, 24, 39; 16/113.1

See application file for complete search history.

(56) References Cited

U.S. PATENT DOCUMENTS

| | | | | |
|---|---|---|---|---|
| 5,167,306 | A * | 12/1992 | Carrigan, Jr. ..... | A45C 13/262 190/115 |
| 9,155,369 | B2 * | 10/2015 | Santy ..... | A45C 13/103 |
| 2007/0089952 | A1 | 4/2007 | Herbst et al. | |
| 2009/0166141 | A1 | 7/2009 | Davis et al. | |
| 2014/0131155 | A1 * | 5/2014 | Santy ..... | A45C 13/04 190/119 |

FOREIGN PATENT DOCUMENTS

| | | | | |
|---|---|---|---|---|
| WO | WO 2008098116 | A1 * | 8/2008 | ..... A45C 5/14 |

OTHER PUBLICATIONS

Intellectual Property Office Search Report dated Oct. 30, 2015, Application No. GB1509465.9.

* cited by examiner

*Primary Examiner* — Sue A Weaver

(74) *Attorney, Agent, or Firm* — Hartman Global IP Law; Gary M. Hartman; Domenica N. S. Hartman

(57) ABSTRACT

An article of luggage suitable for use as a seat has a resilient frame that defines top, bottom and side portions of the article, and a brace coupled to the frame and configured to resist displacement of the top portion of the article towards the bottom portion when the article rests on its bottom portion and a user sits on the top portion. Also a method of manufacturing such an article of luggage.

12 Claims, 3 Drawing Sheets

ARTICLE OF LUGGAGE

FIELD OF THE INVENTION

This invention relates to an article of luggage suitable for use as a seat and to a method of manufacturing such an article.

BACKGROUND TO THE INVENTION

Articles of luggage such as suitcases are typically designed to be as lightweight as possible, in order to maximize the weight of the contents of the articles of luggage that can be carried without exceeding weight limits imposed by airlines.

It has been observed that users of articles of luggage such as suitcases often use them as seats, which can cause premature failure of such articles of luggage.

There is thus a need for an article of luggage suitable for use as a seat, but which is not significantly heavier than existing articles of luggage.

SUMMARY OF THE INVENTION

According to a first aspect of the invention there is provided an article of luggage suitable for use as a seat and comprising a resilient frame that defines top, bottom and side portions of the article, and at least one brace coupled to the frame and configured to resist displacement of the top portion of the article towards the bottom portion when the article rests on its bottom portion and a user sits on the top portion.

The resilient frame is preferably rectangular and defines top, bottom and side surfaces of the article.

The resilient frame also defines front and rear openings bounded by the top, bottom and side portions of the article.

The at least one brace is preferably arranged across an opening defined by the frame. In this way, the maximum size of object that can be accommodated in the article for a given volume of the article is increased relative to that which could be accommodated if the at least one brace were arranged inside the frame.

The at least one brace may advantageously define a channel or be tubular, so as to provide rigidity of the at least one brace without significantly increasing the mass of the article.

Where the at least one brace defines a channel or is tubular, it may advantageously form a guide for a retractable towing handle assembly.

In preferred embodiments, the article comprises first and second braces arranged parallel to one another across an opening defined by the frame.

In one embodiment the resilient frame is moulded, preferably from plastics materials and preferably as an endless band.

In another embodiment the resilient frame is formed from a strip of material that is bent into shape and the ends of the strip joined to one another to form an endless band.

The strip of material may advantageously be provided by a row of tubes that are joined to one another along their sidewalls and run parallel to one another along the length of the strip of material. In this way the strip of material provides resilience but has a relatively low density.

The article may advantageously further comprise a reinforcing loop coupled to the resilient frame.

While it is envisaged that the reinforcing loop could run around an exterior or interior surface of the resilient frame, in one embodiment of the invention the reinforcing loop is arranged adjacent to an edge of the resilient frame and surrounds an opening defined by the resilient frame.

Where the at least one brace is arranged across an opening defined by the frame, the reinforcing loop preferably surrounds the other of front and rear openings defined by the frame.

The reinforcing loop may advantageously be moulded, preferably from plastics materials and preferably as an endless band.

Alternatively, or in addition, the reinforcing loop may be formed from metal.

In one embodiment the reinforcing loop is formed of a metal tube that is bent into shape and the ends of the tube joined to one another to form a closed figure.

In preferred embodiments the article further comprises a fabric cover that encloses the frame and the at least one brace and covers front and rear openings defined by the frame.

The reinforcing loop may advantageously be coupled to the resilient frame by attachment to a component to which the resilient frame is attached.

In preferred embodiments, the reinforcing loop is attached by a first fastener to a foot of the article, and the foot is attached by a second fastener to the resilient frame.

Where the article comprises the fabric cover, the reinforcing loop may alternatively or additionally be coupled to the resilient frame by means of fabric loops attached to portions of the fabric cover adjacent to the resilient frame, and/or by means of fabric loops attached to the resilient frame.

The article may advantageously further comprise a reinforcement board located adjacent to the resilient frame such that when the article rests on its bottom portion the reinforcement board underlies the resilient frame.

In one embodiment, the at least one brace is received in a flanged socket and the flanged socket is fastened to the reinforcement board.

According to a second aspect of the invention, there is provided a method of manufacturing an article of luggage suitable for use as a seat, the method comprising providing a resilient frame that that defines top, bottom and side portions of the article, and coupling at least one brace to the frame in a configuration that resists displacement of the top portion of the article towards the bottom portion when the article rests on its bottom portion and a user sits on the top portion.

BRIEF DESCRIPTION OF THE DRAWINGS

The invention will now be described, by way of example, with reference to the attached drawing figures, in which.

DETAILED DESCRIPTION OF EMBODIMENTS

Figure 1:
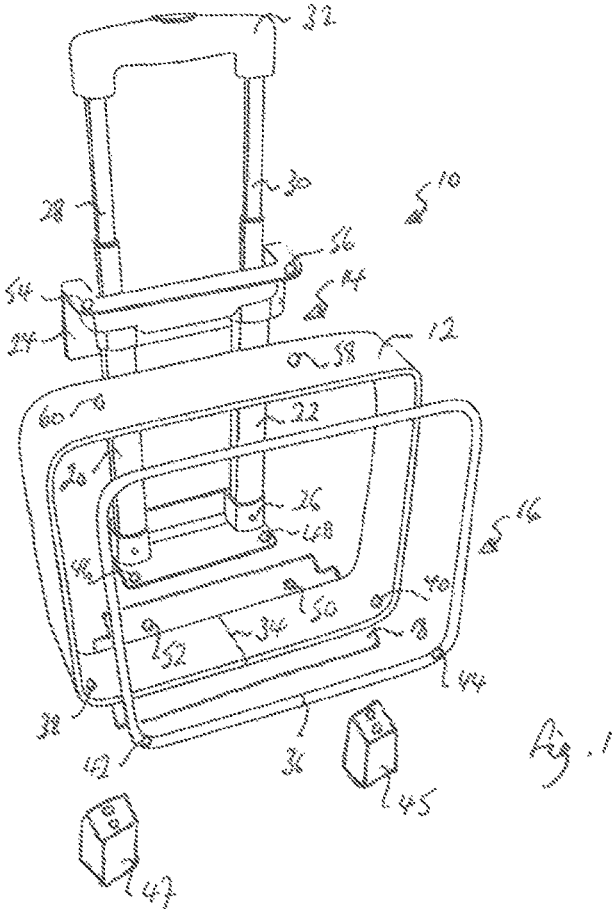
FIG. 1 is an exploded view of some parts of a first embodiment of an article of luggage in accordance with a first embodiment of the invention, wherein the parts include a resilient frame formed from a strip of material that is bent into shape and the ends of the strip joined to one another to form an endless band.

The article of luggage of FIG. 1 is a so-called underseat suitcase 10 comprising a resilient frame in the form of an extruded polypropylene (PP) board 12 bent into a square closed figure, a brace in the form of a retractable towing handle assembly 14 and a reinforcing loop in the form of an aluminium tube 16 bent into a square closed figure. The suitcase 10 also comprises an extruded PP reinforcement board 18 that stiffens the underside of the suitcase.

Figure 5:
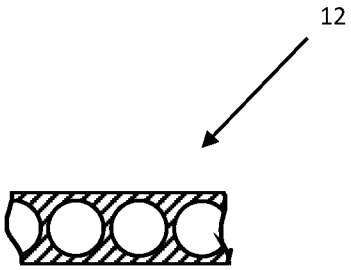
FIG. 5 schematically represents a widthwise fragmentary cross-sectional view of the resilient frame of the article of luggage.

The extruded PP board 12 consists of a row of parallel tubes with neighbouring tubes joined along their walls, for example, as schematically represented in FIG. 5. The board 12 is around 75 mm wide and has a length of around 1320 mm. It is bent into a square shape with rounded corners, each side of the square being around 330 mm in length and the ends of the board 12 meeting at a join 34 in the middle of one side of the square and being taped together.

The retractable towing handle assembly 14 is of conventional construction, comprising first and second aluminium tubes 20 and 22 held in upper and lower PP moulded brackets 24 and 26, the first and second tubes 20 and 22 accommodating respective first and second telescopic bars 28 and 30 joined by a handle 32. The upper and lower brackets 24 and 26 are flanged to enable them to be fastened by bolts or rivets to other components of the suitcase as described in more detail below.

The aluminium tube 16 is of circular cross section with a diameter of around 10 mm. It is bent into a square shape with rounded corners and is of the same dimensions as the square shape formed by the board 12. The ends of the tube 16 meet at a join 36 in the middle of one side of the square and are taped together.

The extruded PP reinforcement board 18 is of similar construction to the extruded PP board 12, having a row of parallel tubes with neighbouring tubes being joined along their walls. The reinforcement board 18 is around 290 mm long and around 170 mm wide, but with rectangular cutouts at the corners of one long side to accommodate the wheels (not shown) of the suitcase.

The suitcase 10 is assembled by placing the reinforcing loop 16 against a front opening formed by the bent extruded PP board 12 with the joins 34 and 36 between their ends adjacent to one another. The sides of the loop 16 and the board 12 that include the joins 34 and 36 form the bottom portion of the suitcase. The board 12 and loop 16 are coupled to one another by means of four bolts (not shown, but the holes for receiving the bolts are shown, denoted by reference numerals 38, 40, 42 and 44), one at each end of the sides of the board 12 and loop 16 that include the joins 34 and 36. The bolts pass through either the loop 16 or the board 12 and into one of first and second feet 45 and 47, on which the suitcase 10 stands when it rests on its bottom portion. The reinforcement board 18 underlies the sides of the board 12 and loop 16 that include the joins 34 and 36. While the reinforcement board 18 is not attached to the loop 16 and board 12, it is kept in tight engagement with them by a fabric cover (not shown in FIGS. 1 and 2 but shown in FIG. 3, denoted by reference numeral 62) of the suitcase. The retractable towing handle assembly 14 is placed against a rear opening formed by the bent extruded PP board 12. The lower moulded bracket 26 is fastened by rivets (not shown, but the holes for receiving the rivets are shown, denoted by reference numerals 46, 48, 50 and 52) to the reinforcement board 18. The upper moulded bracket 24 is fastened by rivets (not shown, but the holes for receiving the rivets are shown, denoted by reference numerals 54, 56, 58 and 60) to the side of the board 12 opposite that side which includes the join 34.

Figure 2:
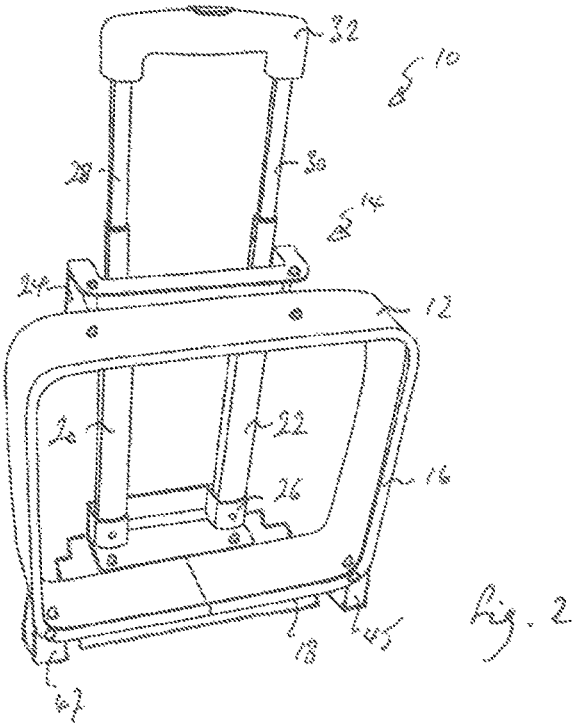
FIG. 2 is an assembled view of the parts of FIG. 1.
Figure 3:
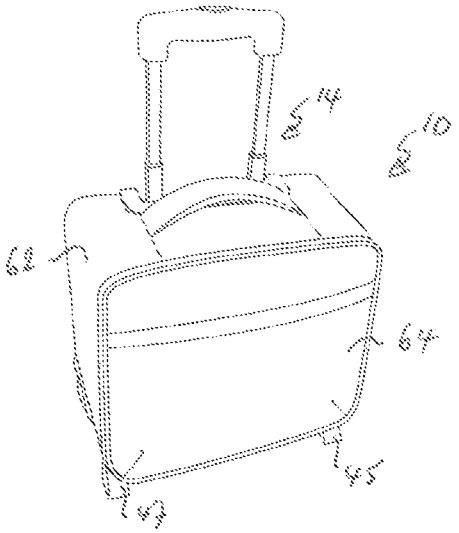
FIG. 3 is a perspective view of the first embodiment of the article of luggage of FIGS. 1 and 2.

Turning to FIG. 3, this shows the fabric cover 62 placed over the parts shown in FIGS. 1 and 2. The fabric cover 62 is generally of conventional construction, having a hinged lid portion 64 with a zip fastener adjacent to the front opening of the board 12 to allow access to the interior of the suitcase 10. The fabric cover 62 differs from conventional fabric covers in that it is provided with fabric loops (not shown) on its internal surface, the loops being located such that when the fabric cover 62 is placed over the parts shown in FIGS. 1 and 2 a fabric loop is available for each side of the loop 16 except that side which includes the join 36, the fabric loops serving to hold the loop 16 adjacent to the front opening of the board 12.

Two further fabric loops (not shown) are fastened by rivets to the side of the board 12 opposite to that side which includes the join 34. The two further fabric loops also serve to hold the loop 16 adjacent to the front opening of the board 12.

Figure 4:
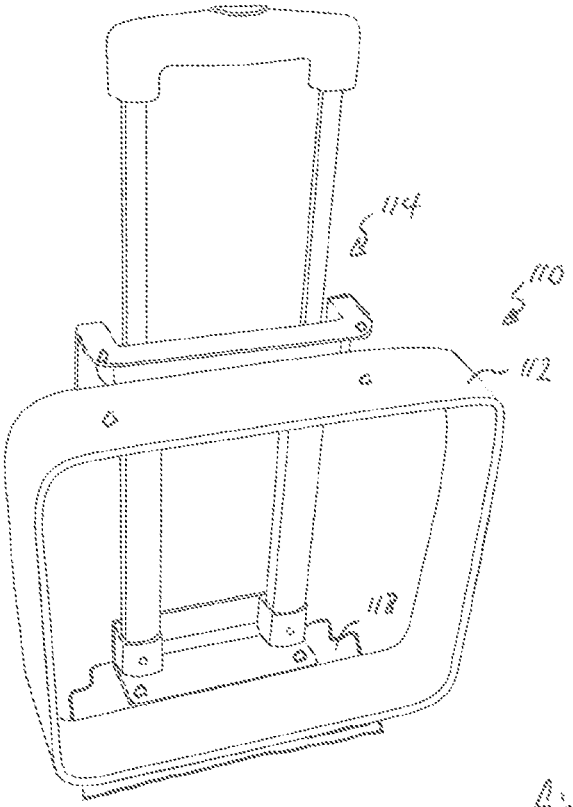
FIG. 4 is an assembled view of some parts of a second embodiment of an article of luggage in accordance with a second embodiment of the invention.

FIG. 4 also shows parts of a so-called underseat suitcase 110 but the resilient frame of this suitcase is constituted by an acrylonitrile butadiene stryrene (ABS) moulding 112 in the form of a square closed figure with rounded corners. The retractable towing handle assembly 114 and reinforcement board 128 are identical to those of FIGS. 1 to 3 but the reinforcing loop 16 is not present, the ABS moulding 112 in conjunction with the retractable towing handle assembly 114 being sufficiently resilient to support the weight of a user sitting on the suitcase 110 without significant displacement of the top portion of the ABS moulding 112 towards the bottom portion.

It will be apparent that the above description relates only to two embodiments of the invention and that the invention encompasses other embodiments as defined by the claims set out hereafter.

The invention claimed is:

1. An article of luggage suitable for use as a seat and comprising a resilient frame that defines top, bottom and side portions of the article, a reinforcement board located adjacent to the resilient frame such that when the article rests on its bottom portion the reinforcement board underlies the resilient frame, and at least one brace coupled to the frame and configured to resist displacement of the top portion of the article towards the bottom portion and a user sits on the top portion, wherein the at least one brace is received in a flanged socket and the flanged socket is fastened to the reinforcement board, the resilient frame is formed from a strip of material that is bent into shape and ends of the strip of material are joined to one another to form an endless band, and the strip of material comprises a row of tubes that are joined to one another along sidewalls thereof and are parallel to one another along a length of the strip of material.

2. The article according to claim 1, wherein the resilient frame is rectangular and defines top, bottom and side surfaces of the article.

3. The article according to claim 1, wherein the at least one brace is arranged across an opening defined by the frame.

4. The article according to claim 3, wherein the at least one brace comprises first and second braces arranged parallel to one another across an opening defined by the frame.

5. The claim 1, wherein the at least one brace defines a channel or is tubular.

6. The article according to claim 5, wherein the at least one brace forms a guide for a retractable towing handle assembly.

7. The article according to claim 1, wherein the resilient frame is moulded.

8. The article according to claim 1, wherein the article further comprises a reinforcing loop coupled to the resilient frame.

9. The article according to claim 8, wherein the reinforcing loop is arranged adjacent to an edge of the resilient frame and surrounds an opening defined by the resilient frame.

10. The according to claim 9, wherein the reinforcing loop is arranged adjacent to an edge of the resilient frame, surrounds an opening defined by the resilient frame, and surrounds the other of front and rear openings defined by the frame.

11. The article according to claim 9, wherein the reinforcing loop is formed of a metal tube that is bent into shape and ends of the tube are joined to one another to form a closed figure.

12. A method of manufacturing an article of luggage suitable for use as a seat, the method comprising providing a resilient frame that defines top, bottom and side portions of the article and a reinforcement board located adjacent to the resilient frame such that when the article rests on its bottom portion the reinforcement board underlies the resilient frame, the resilient frame being provided by bending a strip of material and joining ends of the strip of material to one another to form an endless band, the strip of material comprising a row of tubes that are joined to one another along sidewalls thereof and are parallel to one another along a length of the strip of material; and coupling at least one brace to the frame in a configuration that resists displacement of the top portion of the article towards the bottom portion when the article rests on the bottom portion and a user sits on the top portion, wherein the at least one brace is received in a flanged socket and the flanged socket is fastened to the reinforcement board.

* * * * *